US006142611A

United States Patent [19]

Pan

[11] Patent Number: 6,142,611

[45] **Date of Patent: *Nov. 7, 2000**

[54] OXIDE ISLAND STRUCTURE FOR FLEXIBLE INKJET PRINTHEAD AND METHOD OF MANUFACTURE THEREOF

[76] Inventor: Alfred I-Tsung Pan, 1676 Kennard Way, Sunnyvale, Calif. 94087

[ * ] Notice: This patent is subject to a terminal disclaimer.

[21] Appl. No.: 08/445,984

[22] Filed: May 22, 1995

Related U.S. Application Data

[63] Continuation of application No. 07/965,639, Oct. 23, 1992, abandoned.

[51] Int. Cl.[7] ..... B41J 2/01

[52] U.S. Cl. ..... 347/63

[58] Field of Search ..... 347/64, 63, 65; 346/139 C

[56] References Cited

U.S. PATENT DOCUMENTS

| | | | |
|---|---|---|---|
| 4,287,525 | 9/1981 | Tagawa | 346/139 C |
| 4,314,259 | 2/1982 | Cairns et al. | 346/75 |
| 4,532,530 | 7/1985 | Hawkins | 346/140 R |
| 4,935,752 | 6/1990 | Hawkins | 346/140 |
| 5,008,689 | 4/1991 | Pan et al. | 346/140 R |
| 5,045,870 | 9/1991 | Lamey et al. | 346/140 |
| 5,453,769 | 9/1995 | Schantz et al. | 347/63 |

FOREIGN PATENT DOCUMENTS

| | | | |
|---|---|---|---|
| 0 367 303 A1 | 5/1990 | European Pat. Off. | B41J 2/05 |
| 1-110156 | 4/1989 | Japan | B41J 3/04 |

*Primary Examiner*—Valerie A. Lund

[57] ABSTRACT

A component for a printhead of an inkjet printer includes a flexible substrate and oxide island heat barriers. The oxide islands allow the flexible substrate to be bent without cracking the oxide islands, a problem which otherwise occurs when the heat barrier is a continuous oxide layer. Thin film resistors are supported on the oxide islands and front conductors are connected to back conductors by vias. The flexible substrate can be folded to form monolithic assemblies or the flexible substrate can be bent around a pen body. Discrete heat-spread layers of titanium are provided between the oxide islands and a chromium adhesion layer on the substrate.

5 Claims, 5 Drawing Sheets

OXIDE ISLAND STRUCTURE FOR FLEXIBLE INKJET PRINTHEAD AND METHOD OF MANUFACTURE THEREOF

CROSS REFERENCE TO RELATED APPLICATION

This is a continuation of application Ser. No. 07/965,639 filed on Oct. 23, 1992, now abandoned.

BACKGROUND OF THE INVENTION

1. Field of the Invention

The present invention generally relates to components for printheads for inkjet printers and a process for preparation thereof.

2. State of the Art

FIG. 1 shows an example of a conventional printhead for an inkjet printer. The printhead includes a substrate 1, an intermediate layer 2, and an orifice plate 3. As further shown in the drawing, a nozzle 4 is formed in orifice plate 3 and a vaporization cavity 5 is defined between the substrate 1 and the orifice plate 3. For convenience of illustration, the drawing shows only one of the nozzles 4 in the orifice plate; however, a complete inkjet printhead includes an array of circular nozzles, each of which is paired with a vaporization cavity. Moreover, a complete inkjet printhead includes manifolds that connect vaporization cavities to an ink supply.

Furthermore, in a complete printhead, each vaporization cavity includes a heater resistor such as the resistor 6 in FIG. 1. In practice, all of the heater resistors on a printhead are connected in an electrical network for selective activation. When a particular heater resistor receives a pulse, the electrical energy is rapidly converted to heat which then causes ink adjacent to the heater resistor to form a vapor bubble. As the vapor bubble expands due to the heat provided by an energized heater resistor, the bubble ejects a droplet of ink from the nozzle in the orifice plate. This action is schematically illustrated in FIG. 1 with the direction of bubble growth being indicated by the arrow. By appropriate selection of the sequence of energizing the heater resistors, the ejected ink droplets can form patterns such as alphanumeric characters.

To provide an efficient operation of the resistor, a thermal barrier is provided between the resistor and the substrate on which the resistor is located. In the case of flexible substrates, it has been proposed to use a sputtered oxide layer extending completely over the flexible substrate as the thermal barrier. The resistors and conductors overlie the thermal barrier but when the flexible substrate is bent, it has been discovered that cracking of the oxide layer can lead to electrical shorts through the resistors to a metal adhesion layer provided between the resistors and the underlying polymer material.

SUMMARY OF THE INVENTION

Generally speaking, the present invention provides a component for a printhead of a printer having a flexible substrate with a plurality of spaced-apart resistors on a surface thereof. The resistors are supported on the substrate by a plurality of discrete, thermal barriers. The thermal barriers are spaced-apart from each other and each thermal barrier supports a respective one of the resistors. The thermal barrier can comprise a layer of dielectric material and the thermal barrier can further include a heat-spread layer of material between the dielectric material and the substrate.

The substrate can comprise a polymer material and an adhesion layer of material is provided between the heat-spread layer and the substrate. The adhesion layer can comprise chromium, the heat-spread layer can comprise titanium, the dielectric material can comprise silicon dioxide and the resistors can comprise tantalum-aluminum.

The invention also provides a component of a printhead for a printer having a flexible substrate extending in a longitudinal direction and drop ejection chambers on a first section of the substrate, the drop ejection chambers being located at a first position on the substrate. Orifices are provided in a second section of the substrate, the orifices being located at a second position on the substrate. Bend means for forming a bend in the substrate is provided such that the substrate can be folded and the first and second positions can be aligned in a vertical direction perpendicular to the longitudinal direction. Thin film resistors are disposed on the substrate and each of the resistors is located in a respective one of the drop ejection chambers when the substrate is folded such that the first and second sections are aligned in the vertical direction. Also, thermal barrier means is provided for preventing damage to the flexible substrate when the resistors are heated. The thermal barrier means comprises a plurality of spaced-apart oxide islands, each of the oxide islands supporting a respective one of the resistors.

The invention provides a component of a printhead and process for the manufacture thereof. In particular, the invention relates to an improvement in printheads comprising flexible, extendible substrates wherein the resistors and orifices are provided on the same substrate. The flexible substrates offer efficiency and layout advantages compared to printheads wherein the resistor substrate and orifice plate are separate parts. Briefly, flexible substrates provide more space for laying out resistors and conductors, the arrangement has a higher drop ejection efficiency than an arrangement wherein the resistors and orifices are provided on the same substrate, and flexible substrates allow easy alignment of separate sections which are folded into a monolithic assembly.

The invention also provides a method of forming a component of a printhead, comprising the steps of providing a plurality of spaced-apart thermal barriers on a flexible substrate and providing a plurality of thin film resistors on the substrate such that each of the resistors is supported on a respective one of the thermal barriers. The method can further include depositing discrete, spaced-apart islands of a second adhesion layer on the adhesion layer and depositing a third adhesion layer on the thin film resistors and portions of the adhesion layer not covered by the thin film resistors prior to depositing the conductor means.

BRIEF DESCRIPTION OF THE DRAWINGS

The present invention can be further understood by reference to the following description and attached drawings which illustrate the preferred embodiments. In the drawings.

DETAILED DESCRIPTION OF PREFERRED EMBODIMENTS

Figure 1:
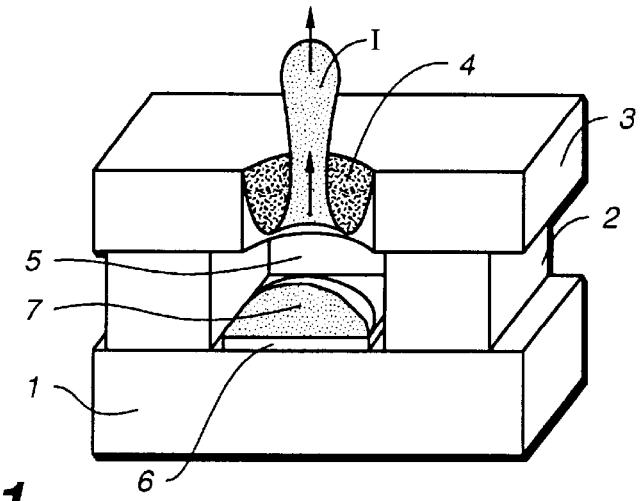
FIG. 1 (PRIOR ART)
FIG. 1 is a cross-sectional view of a portion of a conventional inkjet printhead.
Figure 2:
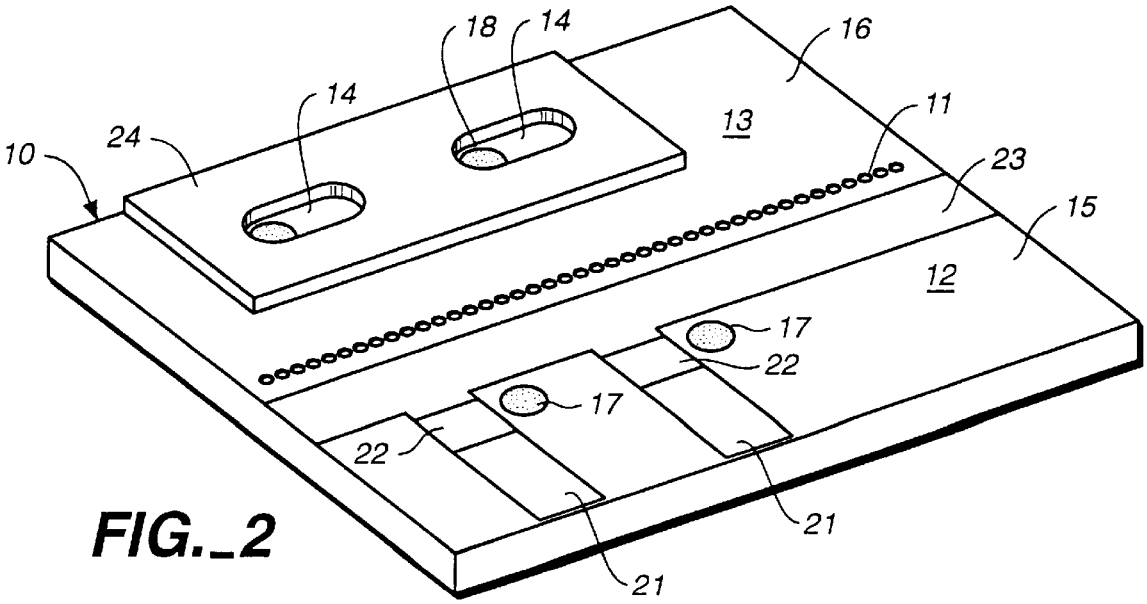
FIGS. 2, 3, and 4 show how a flexible substrate is constructed and bent to form a folded monolithic assembly.
Figure 3:
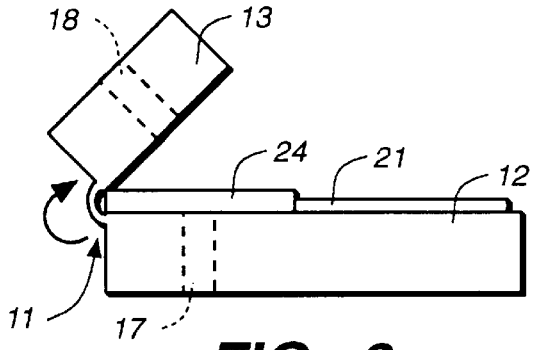
Figure 4:
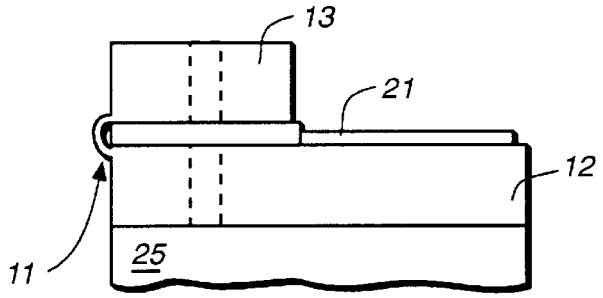

As shown in FIG. 2, a printhead of a thermal inkjet printer includes a flexible substrate 10 having at least one bend means 11 therein such that a first section 12 of the substrate can be bent so as to overlie a second section 13 of the substrate 10, as shown in FIGS. 3 and 4. At least one drop ejection chamber 14 is formed on the surface of the substrate section 13, and at least one ink inlet hole 17 is provided in the first section 12 of the substrate 10 such that the ink inlet hole 17 is in fluid communication with the drop ejection chamber 14 when the two sections 12, 13 overlie each other, as shown in FIG. 4. Furthermore, at least one ink outlet orifice 18 is provided in the second section 13 of the substrate 10 such that the ink outlet orifice 18 is in fluid communication with the drop ejection chamber 14 when the first and second sections overlie each other. In practice, the outlet hole 18 and the inlet orifice 17 are offset.

Compared to conventional printheads, printheads having flexible substrates with the printhead components directly thereon offer a number of advantages. For instance, the flexible substrate can be bent such that one portion of the substrate having one or more components of the printhead overlies another portion of the substrate which has further components of the printhead, thereby providing a unitary structure which is made in a very efficient manner. Furthermore, ink inlet and outlet holes as well as drop ejection chambers can be laser drilled in the flexible substrate. Flexible substrates also offer the possibility of creating large printheads than conventional. The flexible substrate technology also offers the potential for high volume production. In addition, since it is not necessary to use a silicon layer in the flexible substrate technology, there is no need to bond such a silicon layer to the plastic substrate.

Figure 5:
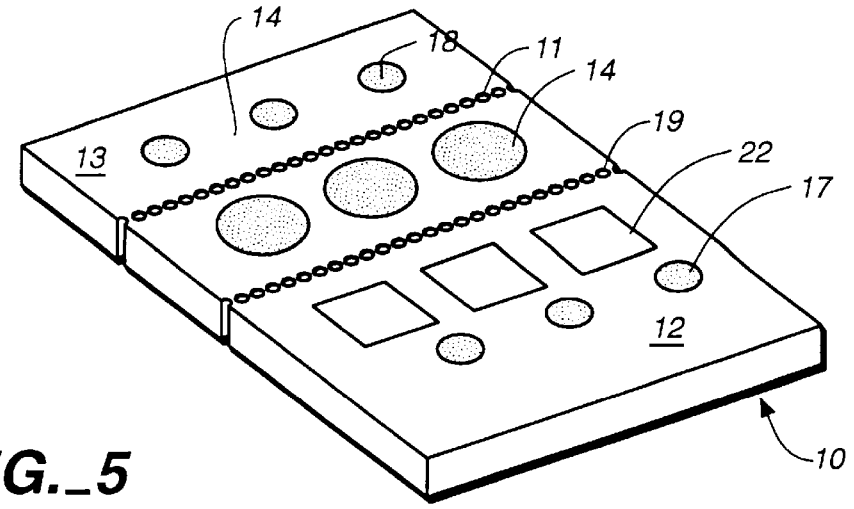
FIGS. 5–8 show how a flexible substrate is bent twice to form a monolithic assembly.
Figure 6:
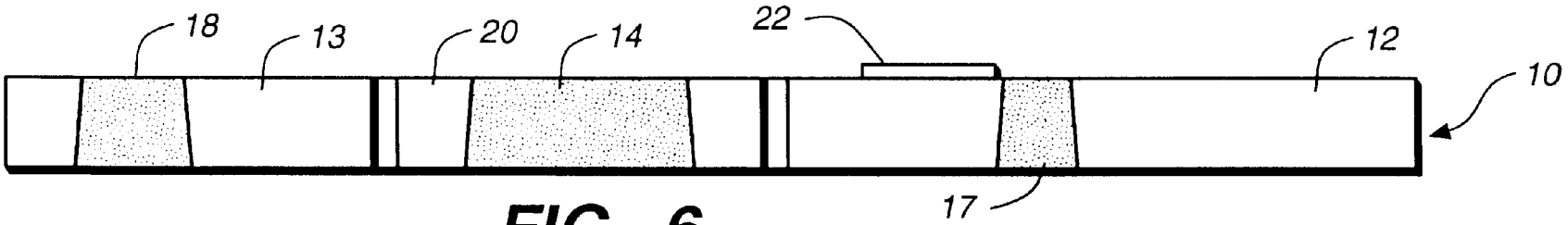
Figure 7:
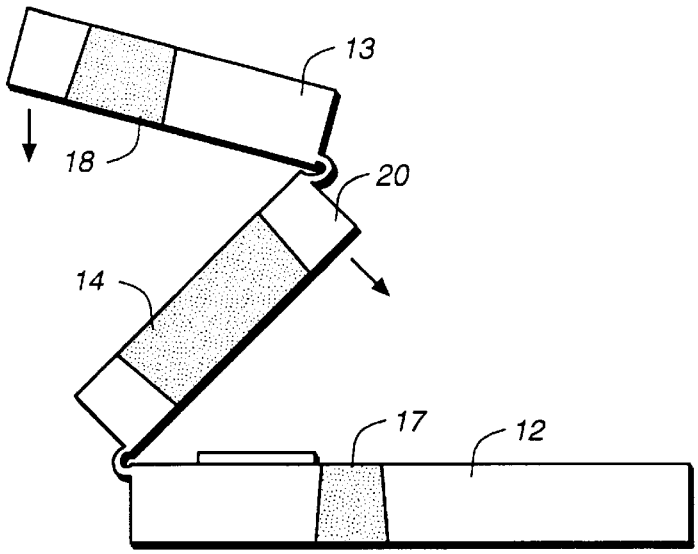
Figure 8:
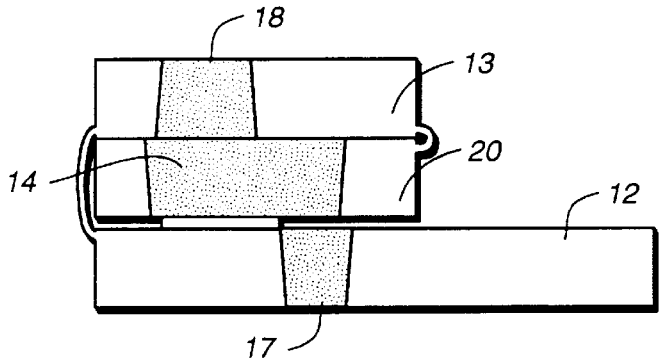

As shown in FIGS. 5 and 6, the flexible substrate 10 can include a second bend means 19 therein such that a third section 20 of the substrate 10 overlies at least one of the first and second sections 12, 13, as shown in FIGS. 7 and 8. The exact number of bend means and configuration thereof is adapted to the particular needs of the device being manufactured.

As shown in FIG. 2, thin film conductor lines 21, thin film resistors 22, a thin film common conductor line 23 and a barrier means 24 is provided on the substrate 10. For instance, the resistors 22 and the outlet holes can be fabricated in a substrate 10, with the outlet holes 18 positioned in the longitudinal direction on the opposite side of common conductor line 23 which extends in a transverse direction. This allows the bend means 11 to be fabricated away from the thin film areas.

For a plastic substrate, such as a polymer material, the bend means 11 could be fabricated by the same process as is used for the various orifices including the ink inlet holes 17 and outlet holes 18, that is, by forming a slot or series of spaced-apart perforations or depressions by laser ablation. Such plastic substrates can have any suitable thickness and thicknesses in the range of 1–3 mils, and can be used for two-fold arrangements such as shown in FIGS. 5–8.

In the case where the substrate 10 comprises a polymer material, such as polyimide or "Upilex", the bend means 11 can be fabricated by photo-ablating or photo-etching the polymer with a high-energy photon laser such as the Excimer laser. The Excimer laser can be, for example, of the $F_2$, ArF, KrCl, KrF, or XeCl type. The Excimer laser is useful for photo-ablating polymer material since this type of laser can provide an energy of about 4 electron volts which is sufficient to break the carbon-carbon chemical bond of PATENT the polymer material. In addition to the above mentioned materials, the polymer can also comprise polymethylmethacrylate, polyethylenetetrephthalate or mixtures thereof. Of these materials, "Upilex" having a thickness of 4 mils, has been found suitable for use as the substrate.

Operation of the resistors 22 is as follows. The resistor material outputs heat when a current is applied thereto. A suitable resistor material is TaAl. To protect the flexible substrate, it is necessary to incorporate a layer of dielectric (e.g. silicon dioxide) underneath the resistors as a thermal barrier as well as a shield for the organic substrate to protect against high-temperature damage. The resistor temperature in operation is typically in excess of 400° C. which is much higher than a typical operational temperature for organic materials. To eject an ink drop, current is supplied to the resistor for a very short time, a layer of liquid adjacent to the resistor is initially heated to a superheated condition and by the time the superheated layer expands to form an ink bubble the heating is stopped. When the superheated layer forms the ink bubble, heat flow from the heat resistor to the ink bubble is negligible and the silicon dioxide conducts heat away from the resistor. Thus, the silicon dioxide initially acts as a heat barrier while the superheated layer of ink is formed and then acts as a heat sink after the ink bubble forms.

Figure 9:
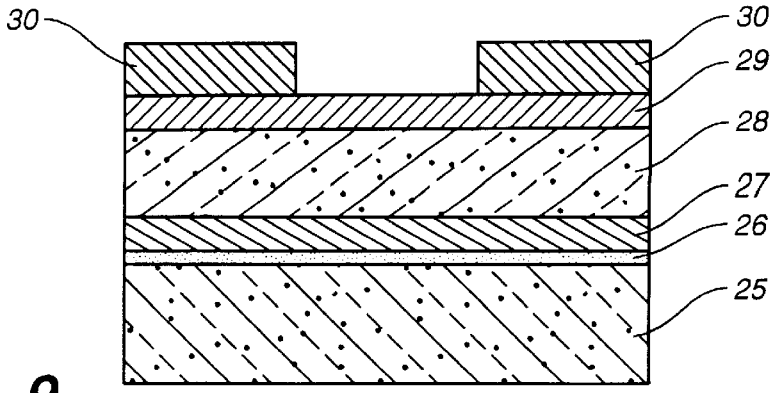
FIG. 9 (PRIOR ART)
FIG. 9 shows a cross-section of a flexible substrate having a continuous thermal barrier on the flexible substrate.

In order to provide adhesion to the polymer substrate, at least one adhesion layer is provided. For instance, as shown in FIG. 9, a flexible substrate 25 can include a first adhesion layer 26, such as chromium. Also, a heat-spread layer 27, such as titanium, can be provided over the adhesion layer 26. A dielectric layer 28, such as silicon dioxide, can then be sputtered or otherwise applied over the layers 26, 27. A resistor layer 29, such as TaAl, can be provided on the dielectric layer, and conductor means 30 (such as gold or aluminum) can be provided on the resistor layer 29.

Figure 10:
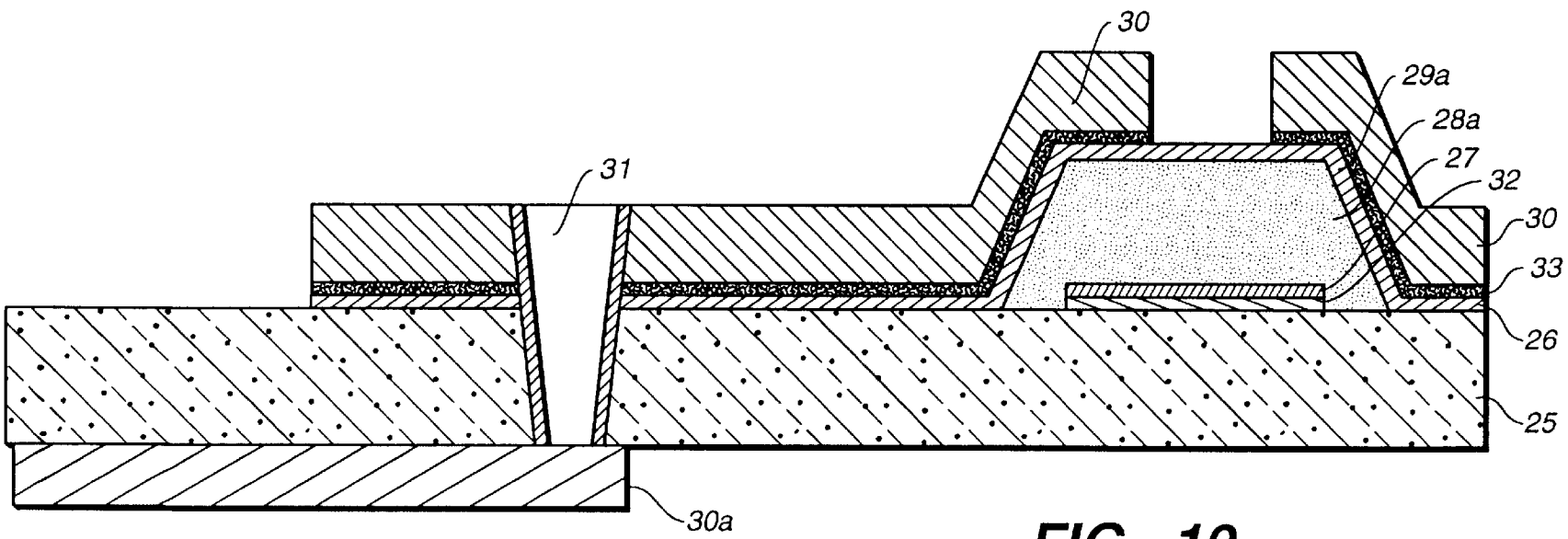
FIG. 10 shows a flexible substrate having the island thermal barrier structure of the invention.

As pointed out earlier, when the continuous layer of dielectric, such as silicon dioxide, is bent, cracking can occur with the result that current passing to the resistor may be electrically shorted to the underlying adhesion layer. The present invention solves this problem by providing spaced-apart oxide islands which underlie the resistors. An example of an arrangement in accordance with the invention is shown in FIG. 10. In particular, instead of the continuous oxide thermal barrier 28 (shown in FIG. 9), a plurality of spaced-apart oxide islands 28*a* are provided. FIG. 10 shows a cross-section of a single oxide island 28*a*.

The arrangement shown in FIG. 10 can be manufactured by the following steps. First, an adhesion layer 26 of chromium is deposited on the flexible substrate 25. The first adhesion layer 26 is deposited in a suitable thickness such as 100 Å. Then, a series of layers are deposited through a shadow mask or by a lift-off process. First, a second layer 32 of chromium is deposited at locations corresponding to the positions of the resistors. The second layer of chromium 32 is provided in a suitable thickness such as 400 Å. Then, a heat-spread layer of titanium 27 is provided on the second chromium layers 32. The layer of titanium is provided in a suitable thickness such as 1500 Å. Next, a layer of a suitable thermal barrier 28*a* is provided on the titanium layer 27. The thermal barrier can comprise a suitable dielectric such as silicon dioxide and is provided in a suitable thickness such as 6000 Å. Finally, a resistor layer 29*a* is provided on the oxide islands 28*a*. The layer 29*a* can comprise any suitable material such as TaAl and is provided in a suitable thickness such as 2500 Å. The shadow mask is then removed and a further adhesion layer 33 is provided on the first adhesion layer 26 and resistors 29*a*. As shown in FIG. 10, the third adhesion layer 33 does not complete cover the resistor material 29*a*. That is, a portion of the resistor material 29*a* is exposed so that ink can contact the resistor. The third adhesion layer 33 can comprise any suitable material such as chromium and is provided in a suitable thickness such as 400 Å. Then, conductors 30 are deposited on the third adhesion layer 33. The conductors 30 can comprise any suitable material such as gold or aluminum, although gold is preferred. The conductors can be provided in a suitable thickness such as 5000 Å. In addition to the conductors 30 which are provided on a front surface of the substrate 25, backside conductors 30*a* is provided on the backside of the substrate 25. In order to connect the front conductors 30 with the backside conductors 30*a*, vias 31 is provided which extend through the substrate 25.

As pointed out above, a continuous oxide thermal barrier normally cannot withstand mechanical deformation and the presence of this brittle dielectric on a flexible substrate renders it especially susceptible to cracking during the flexing of the substrate or upon any concentrated loading such as is encountered during a TAB bonding operation. The oxide island structure according to the invention offers an architecture that allows the oxide to be present only where it is needed, that is, underneath the resistors. The rest of the substrate is thus oxide free and is mechanically much more robust.

One of the potential advantages of building a thermal inkjet printhead on flexible substrates is that both the thermal inkjet head and its electrical interconnections can be built on the same substrate, that is, the flexible substrate. The interconnect circuit can then be bent and wrapped around a pen body for connecting it to a printer. With a uniform oxide structure, the bending of the circuit will damage the oxide and destroy the interconnect circuit.

The presence of a continuous uniform oxide also makes it very susceptible to any concentrated loading such as a TAB bonding operation. A typical bonding strength of a TAB to a gold thin film in the present thermal inkjet printhead is 80 gm (pull strength). The susceptibility to cracking of the oxide layer mandates a reduction of the force applied during the TAB bonding operation. A typical bond strength is thus reduced to about 5 gm. The presence of a continuous uniform oxide also makes it very sensitive to damage during processing of the flexible substrate. Any unintentional flexing of this substrate will inevitably crack the oxide layer.

The structure of a continuous uniform oxide also presents a problem in forming plated vias between the front and back sides of the substrate. The presence of a continuous uniform titanium heat-spread layer and chrome adhesion layer beneath the oxide will result in the electrical shorting of all conductor lines to these layers. The oxide island structure of the invention solves these problems.

The foregoing has described the principle preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A component for a Printhead of a printer comprising:

a flexible substrate having a plurality of spaced-apart resistors on a surface thereof, the resistors being supported on the surface by a plurality of discrete, thermal barriers, each of the thermal barriers being spaced-out from the adjacent thermal barriers and supporting a respective one of the resistors;

such that:

bending the substrate 180 degrees in an area without the thermal barriers will not substantially affect the electrical performance of the printhead; and the resistors are for generating heat to eject ink from the printhead.

2. The component of claim 1, wherein the thermal barrier comprises a layer of dielectric material.

3. A component for a printhead of a printer comprising:

a flexible substrate having a plurality of spaced-apart resistors on a surface thereof, the resistors being supported on the surface by a plurality of discrete thermal barriers, each of the thermal barriers being spaced-out from the adjacent thermal barriers and supporting a respective one of the resistors; and each thermal barrier comprising a layer of dielectric material;

wherein each thermal barrier further includes a heat-spread layer of material between the dielectric material and the substrate;

such that:

bending the substrate by 180 degrees in an area without the thermal barriers will not substantially affect the electrical performance of the printhead.

4. The component of claim 3, wherein the substrate comprises a polymer material and an adhesion layer is provided between the heat-spread layer and the substrate.

5. The component of claim 4, wherein the adhesion layer comprises chromium, the heat-spread layer comprises titanium, the dielectric material comprises silicon dioxide and the resistors comprise tantalum-aluminum.

* * * * *